US006168108B1

(12) United States Patent
Morley

(10) Patent No.: US 6,168,108 B1
(45) Date of Patent: Jan. 2, 2001

(54) WEB TENSION CONTROL APPARATUS AND METHOD

(75) Inventor: Robert E. Morley, Overland Park, KS (US)

(73) Assignee: Hallmark Cards, Incorporated, Kansas City, MO (US)

( * ) Notice: Under 35 U.S.C. 154(b), the term of this patent shall be extended for 0 days.

(21) Appl. No.: 09/196,988

(22) Filed: Nov. 20, 1998

(51) Int. Cl.[7] ..... B65H 23/08

(52) U.S. Cl. ..... 242/421.1; 242/421.2; 242/421.7

(58) Field of Search ..... 242/421.1, 421.2, 242/421.7, 421.6, 422.3, 413.5; 226/44

(56) References Cited

U.S. PATENT DOCUMENTS

| | | | | |
|---|---|---|---|---|
| 2,214,355 | * | 9/1940 | Tiselius et al. | 242/421.1 |
| 2,965,326 | * | 12/1960 | Rockstrom | 242/421.1 |
| 3,465,981 | * | 9/1969 | Byrt | 242/421.6 |
| 3,724,733 | * | 4/1973 | Schaffer et al. | 226/44 |
| 3,811,637 | * | 5/1974 | Abler | 242/421.7 |
| 3,936,008 | * | 2/1976 | Crum | 242/421.1 |
| 4,000,865 | * | 1/1977 | Gaskins | 242/421.6 |
| 4,151,594 | * | 4/1979 | Stern | 242/421.1 |
| 4,286,757 | * | 9/1981 | Wirth | 242/421.1 |
| 5,299,753 | * | 4/1994 | Alexander | 242/413.5 |
| 5,441,210 | * | 8/1995 | Hinton | 242/421.1 |
| 5,469,869 | * | 11/1995 | Suzuki et al. | 242/421.1 |
| 5,826,744 | * | 10/1998 | Dell 'Aglio et al. . | |
| 5,826,774 | * | 10/1998 | Dell'Aglio et al. | 226/44 |

* cited by examiner

*Primary Examiner*—John M. Jillions
(74) *Attorney, Agent, or Firm*—Leydig, Voit & Meyer, Ltd.

(57) ABSTRACT

A web tension control and apparatus uses a lightweight dancer and a control system that detects web tension using the dancer position as well as downstream sensors to maintain a relatively constant web tension. The control system also adjusts the braking force to an unwind roll based on the diameter of the roll, allowing for greater web tension control. A two-phase braking system prevents the unwind roll from spilling excess paper into the production line.

19 Claims, 9 Drawing Sheets

FIG. 8
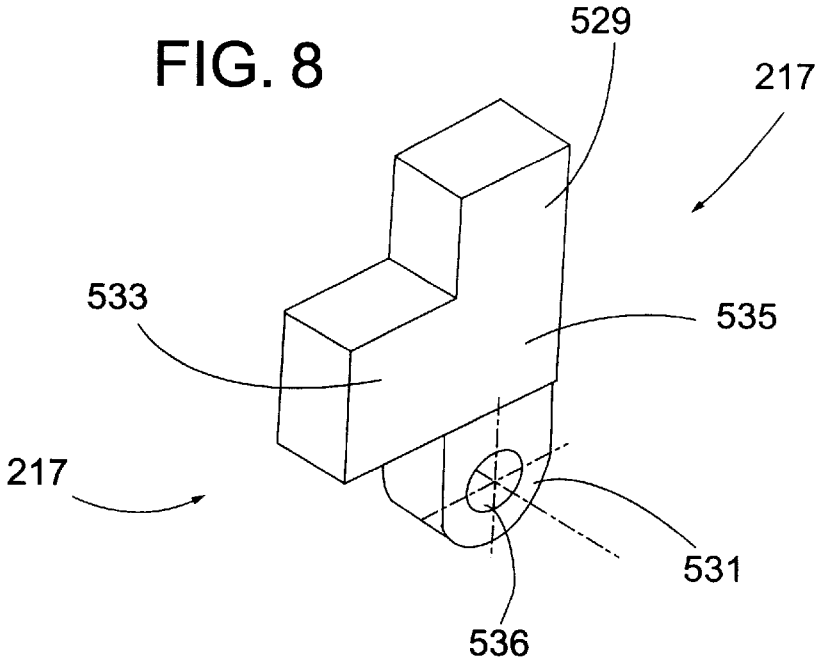
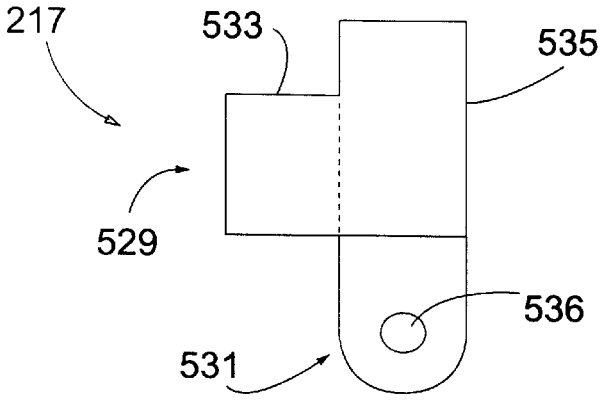
FIG. 9
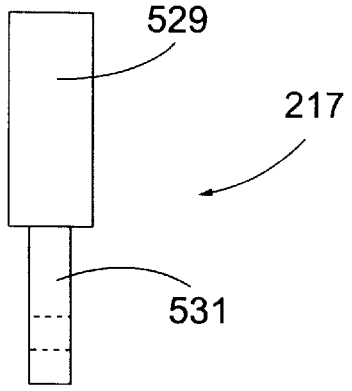
FIG. 10

WEB TENSION CONTROL APPARATUS AND METHOD

TECHNICAL FIELD

The present invention relates generally to web driven processing systems and more particularly to the control of web tension and braking systems and in particular as those systems relate to the production of envelopes.

BACKGROUND OF THE INVENTION

Precise web tension control is important in the printing and paper processing industries. Even small variations in web tension prevent effective application of ink and embossing. In high speed web lines, such as those exceeding 500 feet per minute, manual adjustment of web tension is not possible. Such systems therefore require automated tension control systems.

In systems which control tension using a dancer, one limitation on effective web tension control is the response time of the dancer. Frequently, the dancer movement lags the actual change in web tension, causing the control system to fall behind in reacting to the change and thereby not properly adjusting the tension maintained in the web. One of the primary causes of such delayed reaction is the weight of the dancer. Another cause is insufficient elasticity in the web.

Another problem with achieving precise tension control of a web is the inertia of the web unwind roll which supplies the web to the system. Current systems usually apply braking force to the unwind roll based on web tension, web speed, or supply roll diameter. However, the braking force applied to the supply roll is often poorly matched to the force actually required, since most systems make no provision for possible variations in roll size and weight. The result is that these systems frequently over-apply or under-apply the unwind roll brakes, resulting in large variations in web tension and risking damage to the web as well as the processing equipment.

The lagging response of the dancer to changes in web tension also gives rise to rapid web tension variations when shutting down the web processing line, whether the shut down is routine or as a result of an emergency shut down caused by an error which is detected by a sensor. After the shut down signal is sent, the unwind roll in previously available systems continued turning due to its inertia. This situation caused the dancer festoon to overflow rapidly and thereby waste paper and potentially damaging equipment. Current dancer controlled systems do not react to a shutdown quickly enough to prevent this.

SUMMARY OF THE INVENTION

The invention eliminates the disadvantages of previous web tension control systems by detecting downstream web tension and combining the data with information about the movement of the dancer to take into account the elasticity of the web. The invention also employs a lightweight dancer having a low-friction cylinder and pivoting on low-friction bearings. The control system of the present invention takes the unwind roll inertia into account by activating selected portions of the unwind roll brakes based on the diameter of the roll. Finally, the problems associated with shutdown are solved by monitoring the downstream shutdown controls and generating a short, closed-loop brake pulse to the unwind roll brakes when a shutdown signal is detected.

BRIEF DESCRIPTION OF THE DRAWINGS

While the appended claims set forth the features of the present invention with particularity, the invention may be best understood from the following detailed description taken in conjunction with the following drawings of which:

FIG. 8 is a perspective view of the cleavis of the present invention;

FIG. 9 is a side view of the cleavis of the present invention;

FIG. 10 is a front view of the cleavis of the present invention;

DETAILED DESCRIPTION OF THE INVENTION

Figure 1:
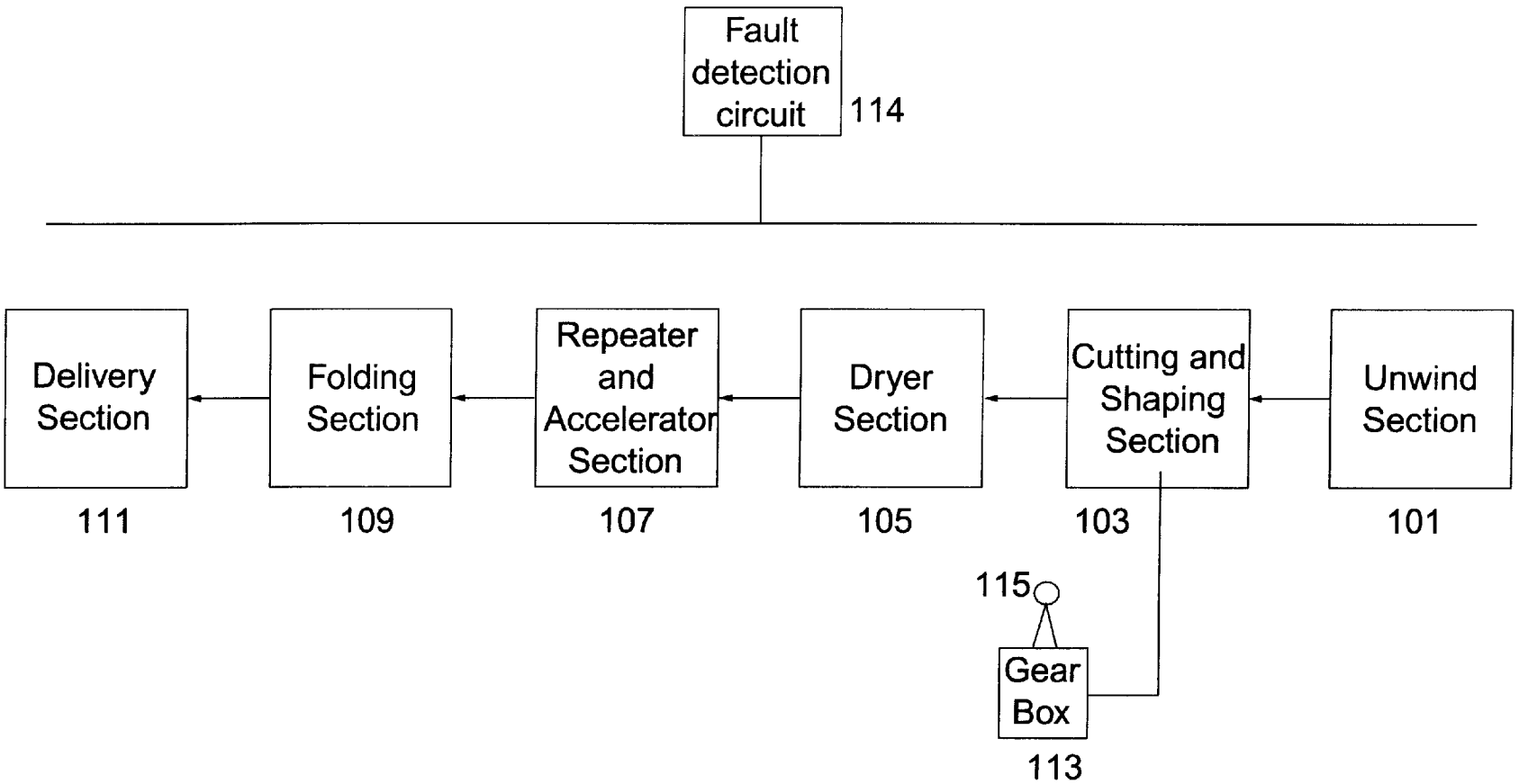
FIG. 1 is a block diagram of an exemplary system incorporating the invention.

An industrial printing and paper processing machine normally performs its tasks on a continuous sheet or "web" of paper. The web of paper is pulled by a power driven "pull" roller through a series of non-driven or "idler" rollers to the various stages of processing, where the paper can be cut into segments, shaped, or stamped. The web is fed into such a machine from a large roll of paper, called an "unwind roll." An unwind roll normally rotates on an roll stand of some sort. It is usually not driven, relying instead on the pulling capability of pull rollers which are driven at various points in the processing equipment. Many unwind roll systems do have brakes, however, to assist in controlling web tension.

One problem with current unwind roll braking systems is that they do not react quickly enough during a machine shutdown to avoid spilling paper into the system, exceeding the capacity of the festoon or dancer. Since these machines often run at speeds of 1000 feet per minute, the amount of wasted paper is considerable.

Because the web often moves at different speeds through different sections of the machine, it frequently becomes slack. To prevent a slack web from becoming tangled, bunched, or wrinkled, a web processing system, such as an envelope production system, frequently employs a "festoon" and/or a "dancer." A festoon is a series of idler rollers designed to hold excess web material in a non-damaging manner. A dancer is typically one or more idler rollers or non-rotating arms that are able to "float" or move freely, usually by being mounted on a pivoting frame of some sort. Such a dancer system controls web tension by increasing or decreasing the distance traveled by the web.

Controlling the tension of the web as it travels through a paper processing machine is important for a number of reasons. Variations in web tension can cause smears and imperfections when there is any printing being performed, and can also cause the web paper to be torn or crumpled, resulting in waste. Previous methods of controlling web tension include using the position of a floating dancer arm to gauge the tension and applying or releasing the unwind roll brakes to increase or decrease the tension. While these methods are acceptable for low precision applications where errors of up to plus or minus 0.125 inches are acceptable, they are inadequate for the needs of the current market.

An example of an application requiring high precision is in the area of "registered embossing," in which detailed patterns are stamped onto sections of the web. This kind of procedure can tolerate errors of no more than plus or minus 0.006 inches. This is especially important where printing must be in registration with embossing. Such precision requires the ability to control web tension to within plus or minus 0.5 pounds of a predetermined set point. With such little room for error, the elasticity of the web must be taken into account.

A web is said to have low elasticity when it easily stretches, and high elasticity when it does not. When tension changes in a web of low elasticity, there is a slight delay before the dancer arm moves in response. This delay causes the dancer controller to apply too much or too little braking force to the unwind roll, resulting in variations in tension that are unacceptable for applications like registered embossing. The present invention eliminates this problem using an improved control system and dancer.

The invention is illustrated as being implemented on an envelope cutting, folding, and gluing system. Persons skilled in the art will appreciate, however, that the invention can also be implemented on any system having a web path, including flexography, gravure and lithography presses as well as rewinders, slitters, and sheeters.

FIG. 1 shows a system incorporating the present invention. In a preferred embodiment, this system is a Winkler & Dunnebier Model 399 Envelope Machine.

The envelope machine consists of an unwind section 101, a cutting and shaping section 103, a dryer section 105, a repeater and accelerator section 107, a folding section 109, and a delivery section 111. The web is pulled from the unwind section 101 and is cut and shaped in the cutting and shaping section 103. From this point on, the paper is no longer a continuous web, but is rather a collection of individual sections. These sections of paper then travel through and are processed by the various processing sections 105–109 and emerge at the delivery section 111 as completed envelopes.

During shutdown of the system, an operator disengages the main drive shaft of the cutting and shaping section 103 to prevent any further advancement of the web into the various sections 105–111. Already cut segments of paper continue through and are processed by the dryer section 105, the repeater and accelerator section 107, the folding section 109 and the delivery section 111. After all web material has been processed, the sections 105–111 of the envelope machine are shut down.

Figure 2:
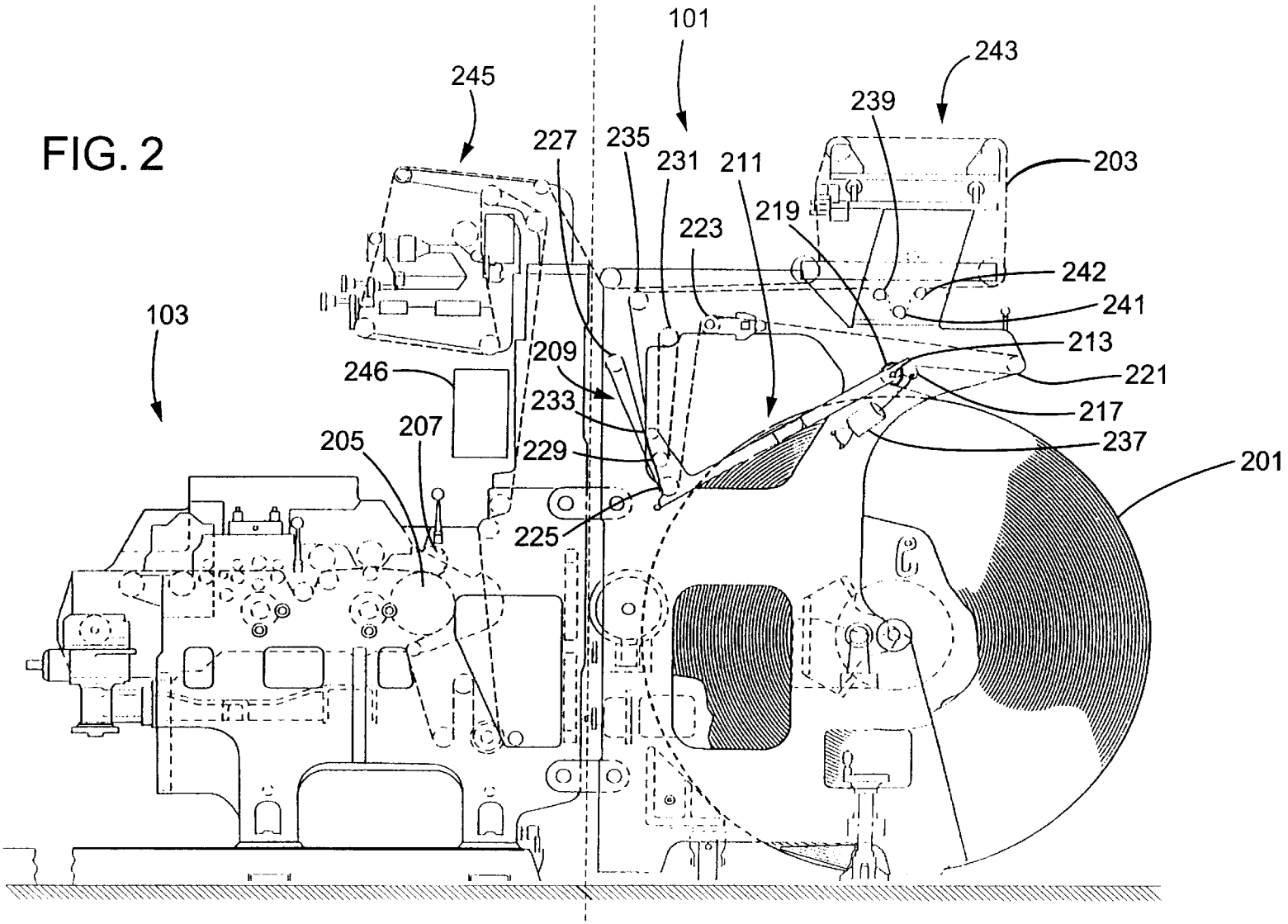
FIG. 2 is a side view of the unwind section and the cutting and shaping section incorporating the present invention.

FIG. 2 is an elevated view of the unwind section 101 and the cutting and shaping section 103. The unwind section 101 contains an unwind roll 201 from which a web 203 is drawn. The pull roller 205 presses the web 203 against a nip roller 207 to form a nip and pulls the web 205 through the entire path of the unwind section 101.

A dancer 209 is provided to control web tension. The dancer includes a dancer assembly 211 pivotally mounted at a point 213 of the frame of the unwind section 101. The dancer assembly 211 has a triangular pulley mount 215 at the end of its long section and a cleavis 217 at the end of its short section. During web processing, the web 203 wraps under fixed idler roller 219, over fixed idler roller 221, over fixed idler roller 223, under floating idler roller 225, over fixed idler roller 227, under floating idler roller 229, over fixed idler roller 231, under floating idler roller 233 and over fixed idler roller 235. A cylinder 237 is anchored to the frame of the unwind section 101 at its base end and rotatably coupled to the cleavis 217 at its plunger end. The cylinder 237 provides a constant, counterclockwise force on dancer assembly 211.

Upon exiting the idler rollers 219, 221, 223, 225, 227, 229, 231, and 235, the web 203 passes over a support roller 239, under a load cell 241, and over a support roller 242. The web 203 then passes through a conventional web aligning system 243, a conventional web printing unit 245, and a rotary embossing unit 246. The rotary embossing unit 246 embosses the envelopes, either to a feature of the envelope such as the envelope's flap or to an image printed by printing unit 245 while the web is traveling at full speed and registered with the embossing plates and/or printing plates, thereby eliminating the need to individually emboss or print finished envelopes. After leaving the rotary embossing unit 246 and printing unit 245, the web is pulled into the cutting and shaping section 103 by the drive roller 205.

Figure 3:
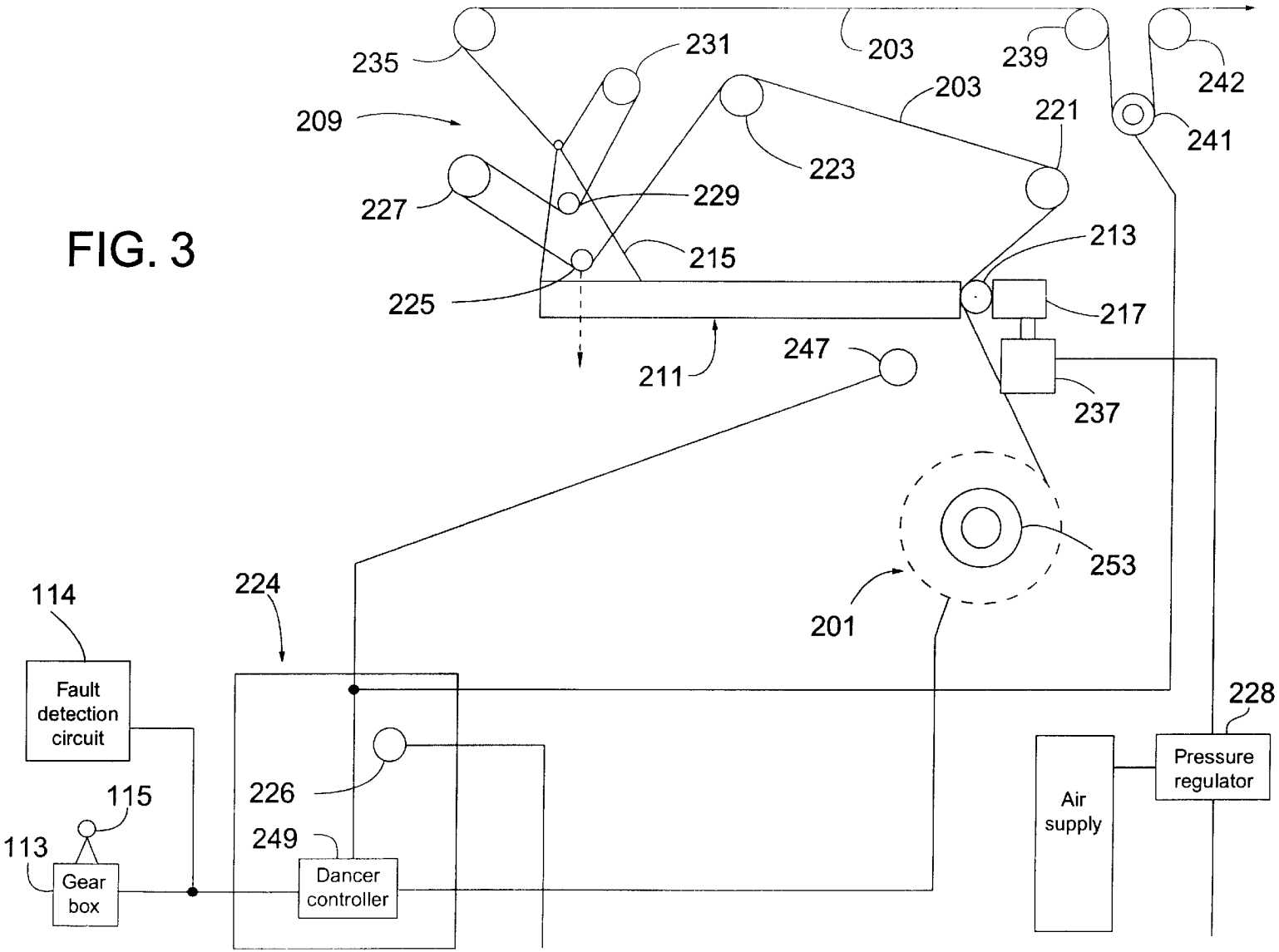
FIG. 3 is a block diagram and illustration of the web showing the overall function of the control system incorporating the present invention.

As seen more clearly in FIG. 3, a control system is employed in the unwind section 103 in the preferred embodiment of the invention. During normal operation, the weight of the dancer assembly 211, including the pulley mount 215, and the floating idler rollers 225, 229, and 233 create a counter clockwise torque on the dancer assembly 211 around a point 213.

In operating the envelope machine, an operator sets the desired web tension at a control panel 224 by adjusting a rotating control 226 to cause a pressure regulator 228 to add or release pressure from the air cylinder 237. Typically in the above identified envelope processing system, this tension is one pound per inch of web width. Upward pressure from the air cylinder 237 adds to the counter clockwise torque on the dancer assembly 211. Tension in the web 203 creates an upward force on rollers 225, 229, and 233 that, combined with the weight of cleavis 217, results in a clockwise torque on the dancer assembly 211 around point 213 equal to that of the counter clockwise torque.

The dancer assembly 211 remains stationary under these balanced conditions. In the preferred embodiment, the dancer controller 249 is a Warner Electric TCS-210W Dancer Control; the air cylinder 237 is a Bellofram size 24, stroke F Super Cylinder; and the pressure regulator 228 is a Bellofram Type 41-2 regulator with ¼ inch ports.

Any increase or decrease in the tension of the web as a result of machine operations or web 203 breakage changes the force exerted on the floating idler rollers 225, 229, and 233, causing the dancer assembly 211 to move around pivot point 213 in either a clockwise or counter clockwise direction. A dancer position sensor 247 senses a change in the angular position of the dancer assembly 211 and generates a corresponding signal to the dancer controller 249. In the preferred embodiment of the invention, the dancer position sensor 247 generates between 0 and 15 volts, where 0 volts represents topmost position of the dancer assembly 211 and 15 volts represents the bottom most position of the dancer assembly 211.

A change in the tension of the web 203 also causes a change in the force applied by the web 203 on a load cell 241. The load cell 241 senses the change and generates a corresponding signal to the dancer controller 249. In the preferred embodiment, the signal generated by the load cell 241 is approximately 0.0025 volts per pound of change in web tension, and is positive when the tension of web 203 increases, and negative when the tension decreases. Dancer controller then adds the signal from the load cell 241 to the signal from the dancer position sensor 247 to compensate for the elasticity of the web. In effect, the load cell 241 signal acts as a vernier adjustment to the dancer position sensor 247 signal.

The dancer controller 249 then compares this result with the voltage representing an operator-defined neutral position for the dancer assembly 211 and changes the level of the voltage being sent to the unwind roll brake unit 253. In the preferred embodiment, the dancer position sensor 247 is a Dana/Warner model MCS-605-1 Dancer Position Detector, and the load cell 241 is a pair of transducers (part number MO-04491-40) from Cleveland Machine Controls.

Figure 4:
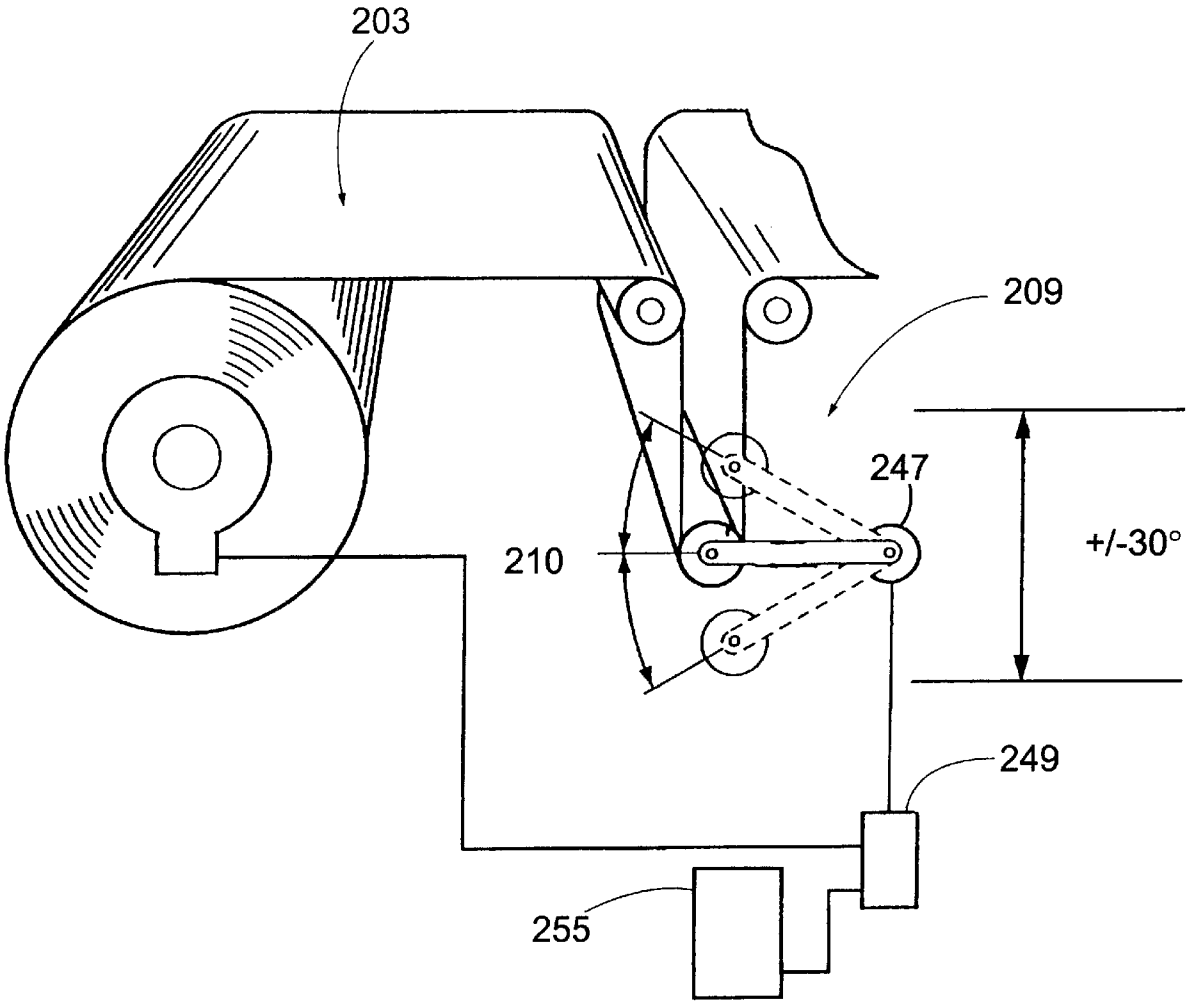
FIG. 4 is a drawing illustrating the movement of the dancer assembly of the present invention.

The possible positions of the dancer assembly 211 may be seen in FIG. 4. If the calculated angular position of the dancer assembly 211 is above the neutral position 210, dancer controller 249 decreases the voltage to brake unit 253, thereby decreasing the stopping force applied by the unwind roll brakes. This action decreases the total tension of web 203. If the calculated angular position is below the neutral position 210, then the opposite effect occurs, and the force applied by the unwind roll brakes increases, slowing the unwind roll 201 and causing an increase in web tension. This control scheme maintains the web tension to within plus or minus 0.5 pound of the operator-set web tension.

A control system configured according to the present invention can also be used during shutdown to prevent the unwind roll from spilling excessive amounts of paper into the production line, which can result in wasted paper and damaged equipment. Referring to FIG. 3, when an operator pulls the lever 115 of the gearbox 113 to disengage the main drive shaft of the cutting and shaping section 103, or when the fault detection circuit 114 automatically shuts the envelope machine down as a result of a malfunction, a shutdown signal is sent to the dancer controller 249. If the diameter of the unwind roll 201 is small, then the dancer controller 249 does not react to the signal. Although the pull roller 205 stops pulling the web 203 when the main drive shaft is disengaged, the unwind roll 201 continues to rotate due to inertia, and adds paper to the dancer. This extra paper creates slack in the web 203. As described above, the dancer controller 249 reacts to this decrease in web tension by increasing the braking force of the unwind roll brakes. Eventually, the unwind roll comes to a complete stop.

If the unwind roll 201 is large, then the dancer controller 249 reacts to the shutdown by generating a short, high voltage braking signal to the unwind roll braking unit 253, causing the unwind roll brakes to engage quickly and then disengage. This pre-braking phase eliminates excess inertia from the unwind roll 201.

Following the pre-braking phase, the dancer controller 249 reacts to the decrease in web tension in its normal fashion, as in the case of a small unwind roll.

Figure 5:
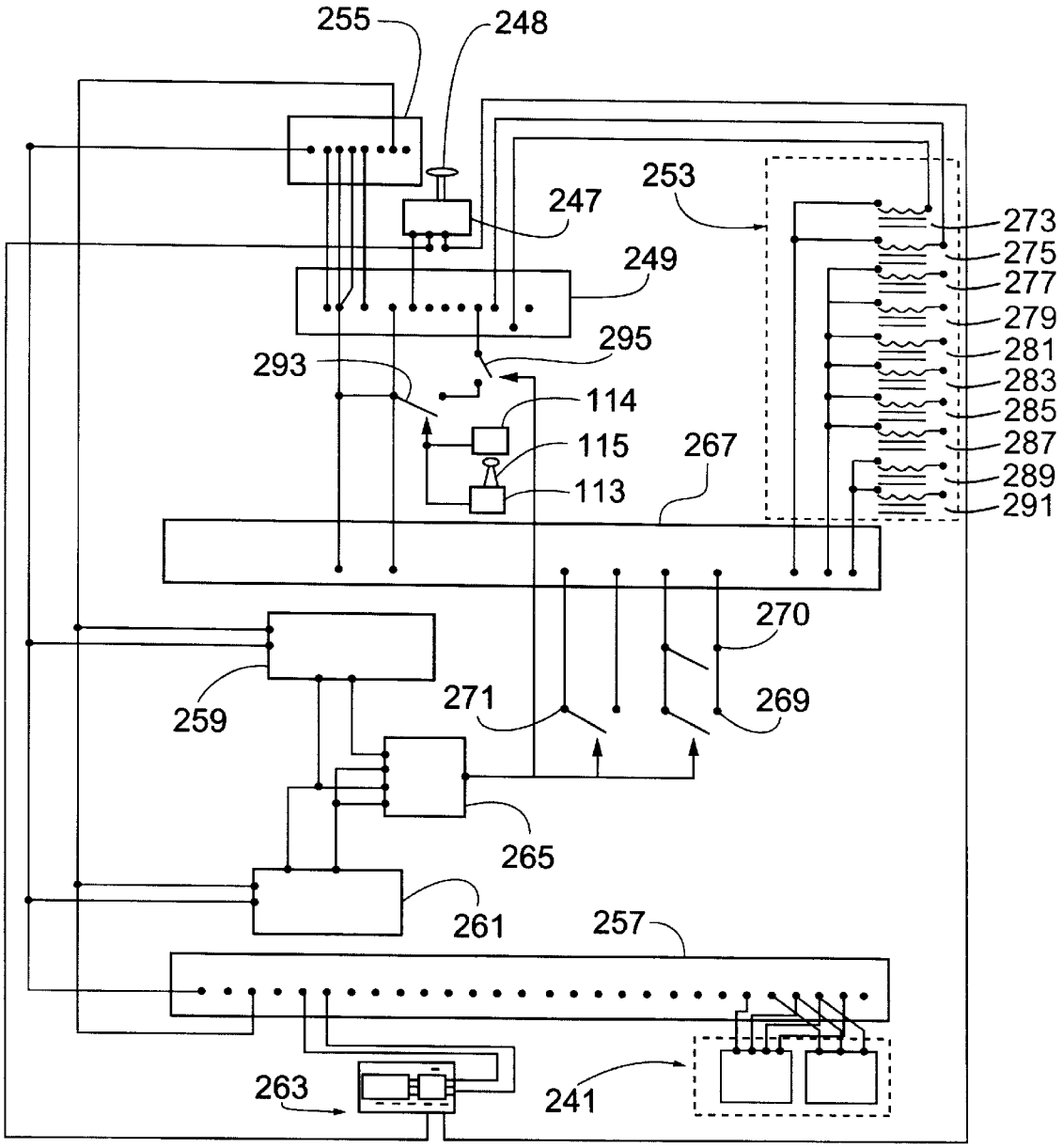
FIG. 5 is a logic diagram showing the electronic layout of the control system incorporating the present invention.

FIG. 5 is a logic diagram showing the control system of a preferred embodiment in detail. An AC power supply 255 provides AC power to the dance controller 249, a web tension controller 257, a roll size detector amplifier 259, a DC power supply 261, and web tension feedback unit 263. The DC power supply 261 converts AC power received from the AC power supply 255 into DC power and provides the DC power to a roll size detector 265. In the preferred embodiment, the AC power supply 255 is a Warner Electric Brake Power Supply model TCS-168, and the DC power supply 261 is a Dana/Warner model 75NG24 24 VDC power supply.

During operation of the unwind section 101 and the cutting and shaping section 103 of the envelope machine, any change in the tension of the web 203 causes a change in the angular position of the dancer assembly 211, and is detected by the dancer position sensor 247, which sends a corresponding signal directly to the dancer controller 249. The load cell 241 detects the web tension change directly and sends a signal to the dancer controller 249 via the web tension controller 257 and a web tension feedback unit 263. The two signals are then summed by the dancer controller 249 to compensate the signal from dancer position sensor 247 for the elasticity of the web 203. In the preferred embodiment, the web tension controller 257 is a Cleveland-Kidder Tensi-Master, Model TMI, and the web tension feedback unit 263 is a Calex Signal Amplifier, model 178 powered by a Calex Power Supply. The dancer controller 249 then converts the summed signal into compensated dancer position value and compares it with an operator-defined neutral position value. It then increases (if the web tension is too low) or decreases (if the web tension is too high) the voltage supplied to the brake unit 253 via the static switch 267. In the preferred embodiment, the static switch 267 is a Warner Electric Static Switch, model 819-0360.

As shown in FIG. 5, the brake unit 253 is preferably a Warner Electric model 13-13-10, thirteen inch, ten magnet Modular Tension Brake. The brake unit 253 contains ten independent electromagnetic brake coils 273–291. Two coils 273 and 275 always receive voltage. The relays 269, 270 and 271 control which of the remaining eight brake coils 277–291 receives the voltage supplied by the dancer controller 249. When the relay 269 or the relay 270 is closed, the coils 289 and 291 receive voltage, while closing the relay 271 causes coils 277–287 to energize.

The roll size detector 265 senses the outer diameter of the unwind roll 201 and generates a corresponding signal to the roll size detector amplifier 259. The roll size detector amplifier 259 increases the magnitude of the signal and sends it to the relays 269, 270 and 271.

In the preferred embodiment, the relay 269 closes when the unwind roll diameter is between 28 and 36 inches and the relays 270 and 271 close when the diameter is between 36 and 59 inches. Different web systems may require different relay settings, depending on the size and weight of the unwind roll, the speed of the web, and the volume of the dancer assembly. When the unwind roll diameter is less than 28 inches, only the coils 273 and 275 are energized. In the preferred embodiment, the above mentioned components are implemented as follows: the detector 265 is a Dana/Warner model UT30 ultrasonic proximity detector; the amplifier 259 is a Dana/Warner model MCS 680-8 amplifier; the relays 269, 270 and 271 are Allen-Bradley 24 VAC/DC model 700 type H relays with gold diffused contacts.

When an operator pulls the lever 115 of the gearbox 113 to disengage the main drive shaft of the cutting and shaping section 103, or when the fault detection circuit 114 automatically shuts the envelope machine down as a result of a malfunction, a first relay 293 closes for a short duration and then reopens. As shown in FIG. 5, the first relay 293 is in series with a second relay 295. The second relay 295 receives the output of the roll size detector amplifier 259, and in the preferred embodiment, closes when the unwind roll diameter exceeds 40 inches. In the preferred embodiment, the second relay 295 is an Allen-Bradley 24 VAC/DC model 700, type H relay with gold diffused contacts, while the first relay 293 is an Allen-Bradley 24 VAC/DC model 700, type H one-shot, time delay relay that opens for 0.4 seconds at a time.

If a shutdown occurs and the unwind roll diameter is above 40 inches, the second relay 295 closes, and the first relay 293 closes for 0.4 seconds. When these two relays are closed, the dancer controller bypasses the closed loop response of the dancer controller, and for 0.4 seconds, generates "preconditioning" high voltage pulse to the active coils of the brake unit 253, regardless of any change in web tension. This eliminates the excess inertia of the unwind roll.

Figure 6:
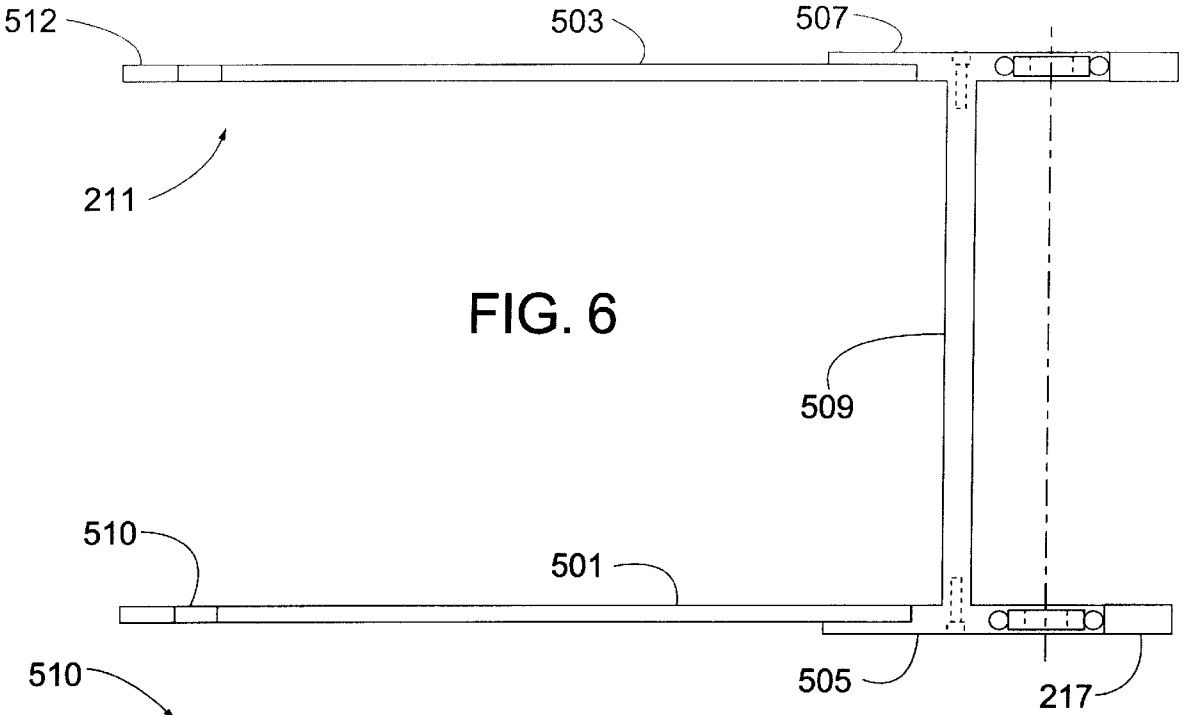
FIG. 6 is a top view of the dancer assembly of the present invention.
Figure 7:
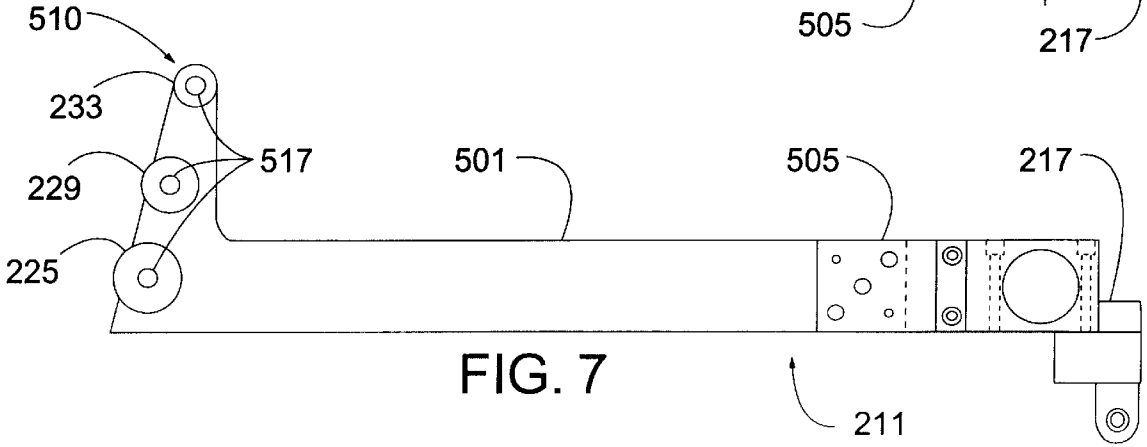
FIG. 7 is a side view of the dancer assembly in FIG. 6.

FIG. 6 and FIG. 7 show a top view and a side view of the dancer assembly 211 of the present invention. The dancer assembly 211 includes arms 501, 503, support pieces 505, 507, and a cross brace 509. The arm 501 has a cleavis 217 welded to one end. The arms 501, 503 are parallel to each other and are preferably about 17.625 inches apart in the preferred embodiment. The arms 501, 503 have triangular sections 510 and 512 that support three roller shafts 517. Each of the roller shafts 517 is about 17.375 inches long, 0.591 inches in diameter, and made of solid steel in the preferred embodiment. The floating idler rollers 225, 229, 233 are 16 inch long steel tubes 1.5 inches in diameter having 0.222 inch thick steel walls in the preferred embodiment. The floating idler rollers 225, 229, 233 are preferably rotatably mounted on the three shafts using greased ball bearings (not shown).

The cross brace 509 is (not shown) a hollow steel tube 1.325 inches in diameter having 0.125 inch thick walls in the preferred embodiment. The brace 509 is 17.325 inches long in the preferred embodiment and is conventionally mounted to the support sections 507 and 505.

FIG. 8, FIG. 9, and FIG. 10 show the cleavis 217 in greater detail. An upper section 529 is 1 inch thick steel in the preferred embodiment, and has a first section 533 and a second section 535. The first section 533 is 1.694 inches high and 1.47 inches wide in the preferred embodiment. The second section 535 is 2.694 inches tall and 1.53 inches wide in the preferred embodiment. The lower section 531 is made of 0.5 inch thick steel and is 1.53 inches wide and 1.75 inches long (at its longest point) in the preferred embodiment. The lower section 531 has a hole 536 designed to accommodate the plunger end of the cylinder 237.

Figure 12:
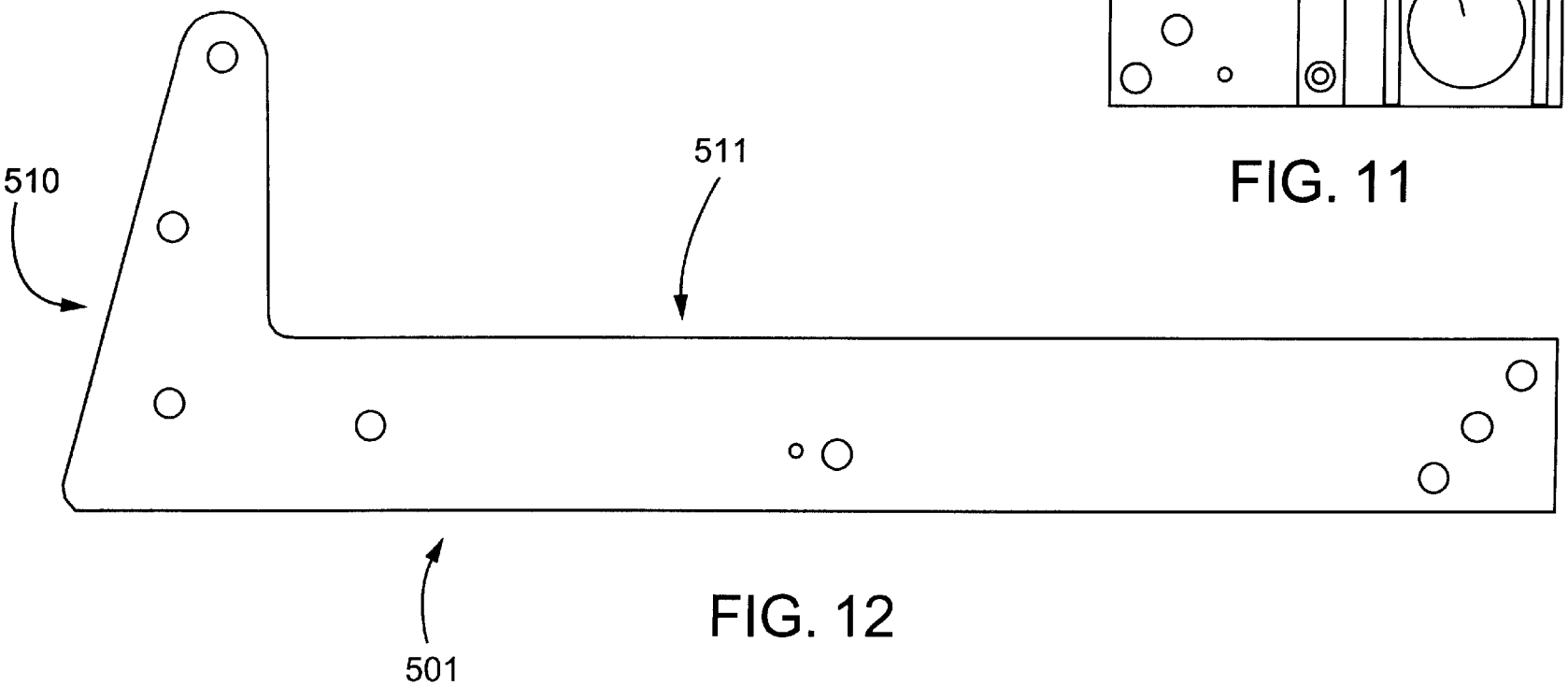
FIG. 12 is a side view of the dancer arm of the present invention.

Referring to FIG. 12, the arm 501 of the dancer assembly 211 has a triangular section 510 that is 8.862 inches from its base to its tallest point in the preferred embodiment. The triangular section 510 has three holes sized to accommodate a set of roller shafts, as described above. A straight section 511 is 26.687 inches in length and 3 inches in height in the preferred embodiment. The entire arm is made of 0.5 inch thick aluminum in the preferred embodiment. The arm 503 is identical in construction to the arm 501.

Figure 11:
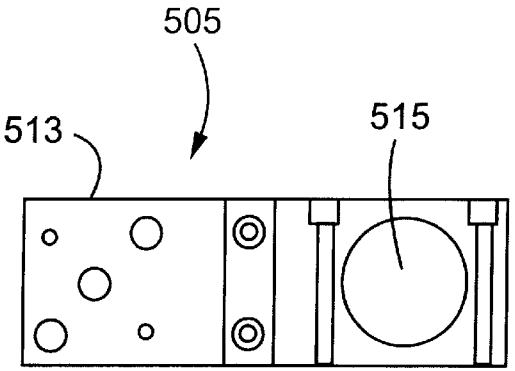
FIG. 11 is side view of the dancer arm support section of the present invention.

Referring to FIG. 11, a support section 505 is made from aluminum and has a height of 3 inches and a length of 9.5 inches in the preferred embodiment. The support section 505 is 0.5 inches thick for a distance of 3 inches starting at end 513, and 1 inch thick for the remaining 6.5 inches in the preferred embodiment. Holes are drilled appropriately to accommodate bolts for attaching the support section 505 to the arm 501, and for mounting a cross brace 509, as shown in FIG. 6. The support section 505 also has a hole 515 to accommodate a shaft and roller, as described below. The support section 507 identical in construction except that it is oriented to be placed on the opposite side of the dancer assembly 211.

Figure 13:
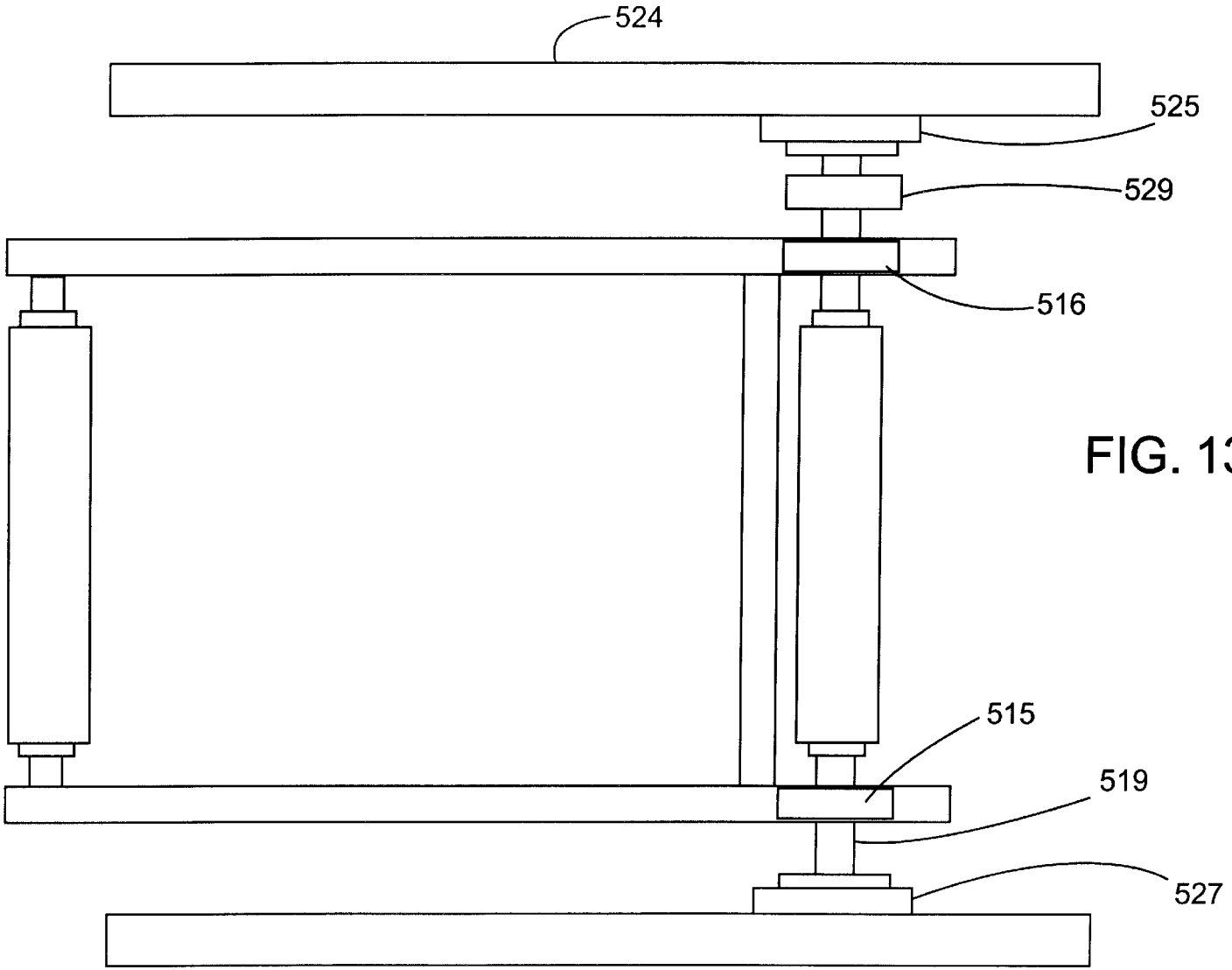
FIG. 13 illustrates the placement of the dancer assembly in the unwind unit incorporating the present invention.

FIG. 13 illustrates the manner of mounting the dancer assembly 211 into the unwind section 101. A roller shaft 519 is mounted in a fixed position in the dancer assembly 211 at the holes 515 and 516. In addition, the roller shaft 519 is rotatably mounted in the walls 521 and 523 on greased bearings inside the journal caps 525 and 527, so that the shaft 519 rotates around its longitudinal axis at the pivot point 213 as the dancer assembly 211 pivots.

A first pulley 529 is mounted on the shaft 519. A belt is wrapped around the first pulley 529 and a second pulley 248 located on the dancer position sensor 247. As the dancer assembly 211 pivots, the first pulley 529 rotates, causing the second pulley 248 to rotate as well. As described above, this allows the dancer position sensor 247 to detect changes in the angular position of the dancer assembly 211.

Operation of the preferred embodiment of the invention can be illustrated and summarized with an example production run of the envelope machine. An operator engages the drive shaft of the cutting and shaping section 103. The pull roller 205 engages the web 203 and starts pulling from the unwind roll 201. The web 203 winds through the fixed idler rollers 219, 221, 223, 227, 231, 235 and the floating idler rollers 225, 229, 233 of the dancer assembly 211 as described above. The web 203 then passes through the support rollers 239, 242 and under load cell 241. The web aligning unit 243 keeps the web 203 laterally aligned.

The web 203 then enters the printing unit 245 and the rotary embossing unit 246. The web 203 then travels into nip roller 207 and pull roll 205. If the web 203 slows down, slack is created at the floating idler rollers 225, 229, 233. As a result, the weight of the long end of dancer assembly 211 combined with the force of the air cylinder 237 create a counter clockwise torque on dancer that exceeds the upward force of web 203 on the floating idler rollers.

In response, the dancer assembly 211 rotates counter clockwise around the pivot point 213, and this movement is detected by the dancer position sensor 247. Furthermore, the slack in the web 203 is also detected by the load cell 241. The load cell and dancer position sensor information are relayed to the dancer controller 249, which responds by causing the brake unit 253 to slow the unwind roll 201. The specific parts of brake unit 253 employed depend on the diameter of the unwind roll 201, as detected by roll size detector 265. Slowing unwind roll 201 increases the web tension, causing the dancer assembly 211 to rotate clockwise. As the dancer assembly 211 returns to its neutral position, the dancer controller 249 reduces the unwind roll braking force.

When enough envelopes have been produced, the operator disengages the drive shaft of cutting and shaping section 103 by pulling lever 115 of gear box 113. This action generates a signal to the control system of the present invention. If the unwind roll diameter is large, then dancer controller 249 generates a fixed pulse to the brake unit 253 without regard to the position of the dancer assembly or the load cell tension. The dancer controller 249 then returns to a closed loop mode, using the dancer position and load cell data to control the brake unit 253.

In view of the many possible embodiments to which the principles of this invention may be applied, it should be recognized that the embodiment described herein with respect to the drawing figures is meant to be illustrative only and should not be taken as limiting the scope of invention. For example, those of skill in the art will recognize that the illustrated embodiment can be modified in arrangement and detail without departing from the spirit of the invention.

Therefore, the invention as described herein contemplates all such embodiments as may come within the scope of the following claims and equivalents thereof.

I claim:

1. In a web processing system, a method of adjusting web tension comprising the steps of: detecting the diameter of an unwind roll; sensing movement of a dancer, wherein the dancer is responsive to a change in the tension of a web drawn from the unwind roll; and applying a braking force to the unwind roll, the force being a function of the dancer movement and a step function of the unwind roll diameter.

2. The method according to claim 1, wherein the sensing step comprises the steps of: generating a signal corresponding to the dancer position; and comparing the signal to a predefined position standard.

3. The method according to claim 1, wherein the braking force is applied by an unwind roll brake coupled to the unwind roll, the unwind roll brake having a plurality of modules, and wherein the applying step comprises the steps of: selecting at least one module of the plurality to be activated based on the unwind roll diameter; generating a signal proportional to the dancer movement; and activating the selected module with the signal.

4. The method according to claim 3, wherein the unwind roll brake module is selected according to a step function of the unwind roll diameter.

5. The method according to claim 1, further comprising the steps of: detecting a downstream web tension; generating a signal corresponding to the detected web tension; and adjusting the applied braking force based on the detected downstream tension.

6. In a web processing system having an unwind roll from which a web is drawn, a method of preparing an unwind roll for stopping comprising the steps of: detecting the diameter of the roll; applying a preconditioning braking force to the unwind roll when the diameter exceeds a predetermined level; and removing the preconditioning braking force from the unwind roll before the unwind roll stops.

7. The method according to claim 6, wherein the applying step comprises the steps of: overriding a variable web tension feedback signal with a fixed signal; and activating an unwind roll brake with the fixed signal.

8. The method according to claim 6, wherein the braking force is provided by an unwind roll brake coupled to the unwind roll, the unwind roll brake having a plurality of modules, and wherein the applying step comprises the step of selecting at least one module of the plurality to be activated based on the unwind roll diameter; and activating the unwind roll brake module with the fixed signal.

9. A system for controlling web tension in a web processing system comprising: an unwind roll for supplying a web to the processing system; a brake for decelerating the unwind roll; a dancer supporting a roller, wherein the web exerts a force on the roller and the dancer pivots in response to the exerted force; a sensor for measuring a tension of the web downstream of the dancer and generating a tension signal in proportion thereto; and a controller for controlling the brake as a function of the pivoting of the dancer and the generated signal.

10. The apparatus of claim 9, wherein the dancer further comprises a pair of parallel arms pivotably mounted in a frame at a pivot point, each arm having a first and a second end; a hollow roller rotatably mounted between the first ends of the arms, the web traveling along the surface of the roller; and a loading member comprising a base mounted to the frame and a plunger slideably disposed within the base, the plunger exerting torque on the second end of one of the arms.

11. The apparatus of claim 9, further comprising a detector for measuring the diameter of the unwind roll and generating a diameter signal in proportion thereto, wherein the controller controls the brake as a function of the diameter signal.

12. The apparatus of claim 11, wherein the brake comprises a plurality of modules, and wherein one of the plurality is selectable for activation by the controller based on the diameter signal.

13. The apparatus of claim 10, wherein the torque exerted by the plunger is adjustable to establish a desired web tension.

14. In a web processing system, a method of adjusting web tension comprising the steps of: detecting the diameter of an unwind roll; sensing movement of a dancer, wherein the dancer is responsive to a change in the tension of a web drawn from the unwind roll; applying a braking force to the unwind roll, the force being a function of the dancer movement and the unwind roll diameter; detecting a web tension downstream of the dancer; generating a signal corresponding to the detected web tension; and adjusting the applied braking force based on the detected downstream tension.

15. In a web processing system, a method of adjusting web tension comprising the steps of: detecting the diameter of an unwind roll; determining which of a plurality of diameter ranges includes the detected diameter; sensing movement of a dancer, wherein the dancer is responsive to a change in the tension of a web drawn from the unwind roll; and applying a braking force to the unwind roll, the force being a function of the dancer movement and the diameter range determined to include the detected diameter.

16. The method according to claim 15, wherein the sensing step comprises the steps of: generating a signal corresponding to the dancer position; and comparing the signal to a predefined position standard.

17. The method according claim 15, wherein the applying step comprises the steps of: generating a signal proportional to the dancer movement; and activating an unwind roll brake with the signal.

18. The method according claim 15, wherein the braking force is applied by an unwind roll brake coupled to the unwind roll, the unwind roll brake having a plurality of modules and wherein, the applying step comprises the steps of: selecting at least one module of the plurality to be activated based on the unwind roll diameter; generating a signal proportional to the dancer movement; and activating the selected module with the signal.

19. The method according to claim 19, wherein the unwind roll brake module is selected according to a function of the diameter range determined to include the detected diameter.

* * * * *

UNITED STATES PATENT AND TRADEMARK OFFICE

CERTIFICATE OF CORRECTION

PATENT NO. : 6,168,108 B1
DATED : January 2, 2001
INVENTOR(S) : Morley

It is certified that error appears in the above-identified patent and that said Letters Patent is hereby corrected as shown below:

Column 4,
Line 51 "stroke F Super Cylinder; and the pressure regulator 228"
should read -- stroke F Super Cylinder; and the pressure regulator 237 --.

Claim 3 from the specification was omitted — It should be added and should read as follows:

The method according to Claim 1, wherein the applying step comprises the steps of: generating a signal proportional to the dancer movement; and activating an unwind roll brake with the signal.

Claim 19, column 10,
Line 56, "the method according to claim 19" should read -- the method according to claim 18 --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*